United States Patent [19]

Lipp et al.

[11] Patent Number: 4,946,475

[45] **Date of Patent: * Aug. 7, 1990**

[54] APPARATUS FOR USE WITH PRESSURIZED REACTORS

[75] Inventors: Charles W. Lipp; Douglas D. Merrick; Richard A. Lee, all of Baton Rouge, La.

[73] Assignee: The Dow Chemical Company, Midland, Mich.

[ * ] Notice: The portion of the term of this patent subsequent to Aug. 15, 2006 has been disclaimed.

[21] Appl. No.: 279,285

[22] Filed: Nov. 30, 1988

Related U.S. Application Data

[63] Continuation of Ser. No. 39,493, Apr. 16, 1987, abandoned, which is a continuation-in-part of Ser. No. 723,771, Apr. 16, 1985, abandoned.

[51] Int. Cl.[5] ..... C10J 3/48

[52] U.S. Cl. ..... 48/86 R; 48/DIG. 7; 239/132.3; 239/419.3; 239/424.5; 239/428

[58] Field of Search ..... 48/86 R, 27, 73, DIG. 7; 239/132.3, 419.3, 422, 424.5, 427.5, 428, 427.3

[56] References Cited

U.S. PATENT DOCUMENTS

| | | | |
|---|---|---|---|
| 4,386,944 | 6/1983 | Crouch et al. | 48/DIG. 7 |
| 4,443,228 | 4/1984 | Schlinger | 48/86 R |
| 4,525,175 | 6/1985 | Stellaccio | 48/86 R |

*Primary Examiner*—Peter Kratz

[57] ABSTRACT

This invention relates to a process burner for feeding a carbonaceous slurry, an oxygen-containing gas, fuel gas, and optionally, temperature moderators contemporaneously and selectively into a pressurized partial oxidation zone. The process burner feature internal formation of a uniform dispersion of the carbonaceous slurry and the oxygen-containing gas and the high atomization of the carbonaceous slurry.

3 Claims, 3 Drawing Sheets

APPARATUS FOR USE WITH PRESSURIZED REACTORS

CROSS-REFERENCE TO RELATED APPLICATION

Figure 1:
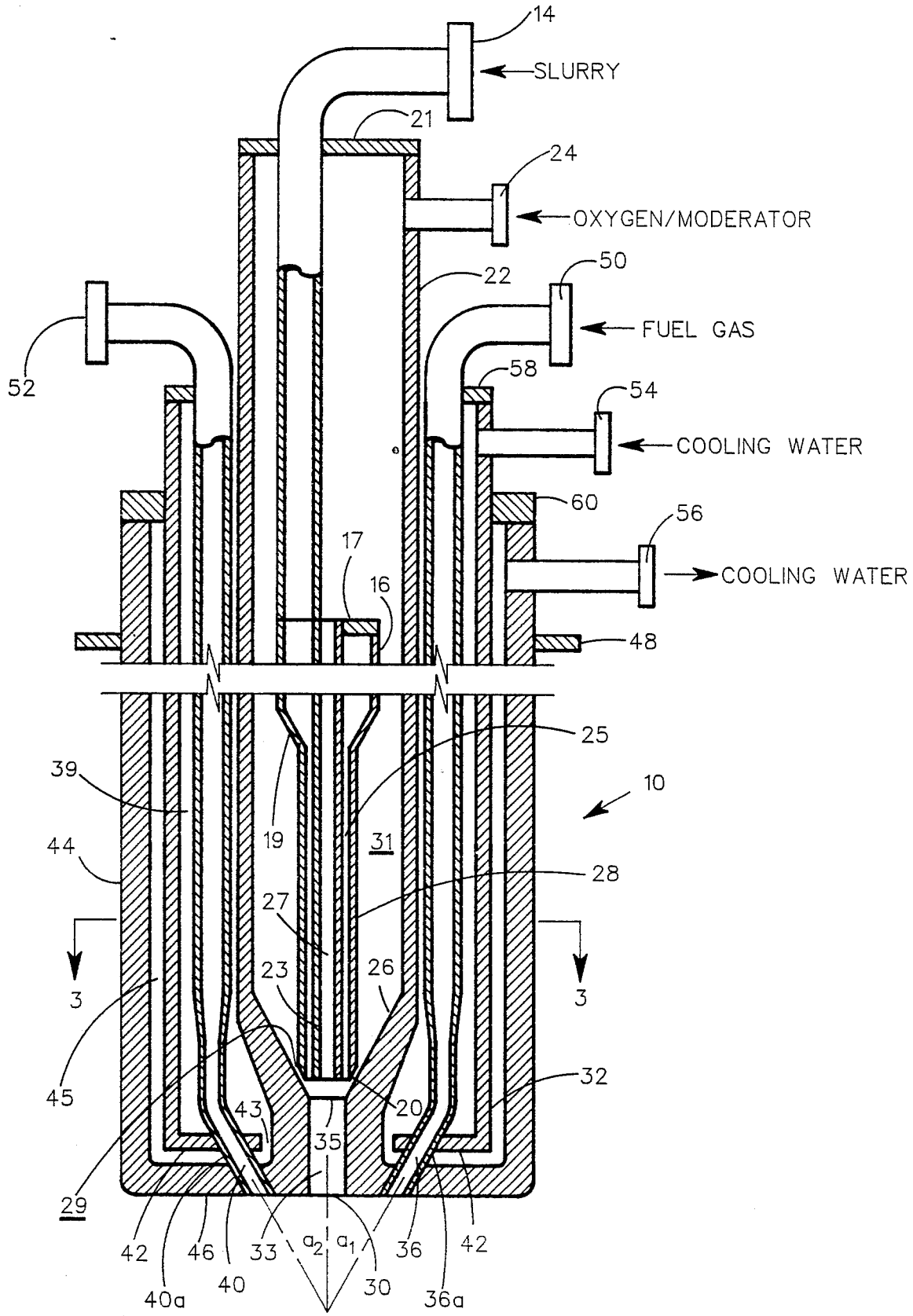

This is a continuation of application Ser. No. 039,493 filed Apr. 16, 1987, now abandoned, which is a continuation-in-part of application Ser. No. 723,771, filed Apr. 16, 1985, now abandoned.

BACKGROUND OF THE INVENTION

This invention relates to a process for introducing fluid feeds to pressurized reactors. This invention also concerns an apparatus capable of effecting such introduction. In one of their more specific aspects, the process and apparatus of this invention relate to the manufacture of $H_2$ and CO containing gaseous products, e.g., synthesis gas, reducing gas and fuel gas, by the high pressure partial oxidation of carbonaceous slurries.

Processes for and apparatuses used in the pressurized partial oxidation of carbonaceous slurries are both well known in the art. See, for example, U.S. Pat. No. 4,113,445; U.S. Pat. No. 4,353,712; and U.S. Pat. No. 4,443,230. In most instances, a carbonaceous slurry and an oxygen-containing gas are fed to a reaction zone which is at a temperature of about 2500° F. (about 1370° C.). Bringing the reactor up to such a temperature can be achieved by at least two methods. In one of the methods, a simple preheat burner is affixed, in a non-airtight manner, to the reactor's burner port. This preheat burner introduces a fuel gas, e.g., methane, into the reaction zone to produce a flame sufficient to warm the zone to a temperature of about 2000° F.–2500° F. (about 1090° C.–1370° C.) at a rate which does not do harm to the reactor refractory material. Generally, this rate is from about 40 F. °/hr (about 22 C. °/hr) to about 80 F. °/hr (about 44 C. °/hr). During this preheat stage, the reaction zone is kept at ambient pressure or slightly below. The less than ambient pressure is desirable as it causes air to enter the reaction zone through the non-airtight connection between the preheater and the reactor, which air is then available for use in combusting the fuel gas. After the desired preheat temperature is achieved, the preheat burner is removed from the reactor and is replaced by the process burner. This replacement should occur as quickly as possible as the reaction zone will be cooling down during the replacement time. Cool downs to a temperature as low as 1800° F. (982° C.) are not uncommon. If the reaction zone is still within an acceptable range, the carbonaceous slurry and the oxygen-containing gas, with or without a temperature moderator, are fed through the process burner to achieve partial oxidation of the slurry. Care must be taken to prevent raising the reaction zone temperature too quickly with the process burner as thermal shock can damage the reactor's refractory material.

If the reaction zone temperature is below the acceptable temperature range, the preheat burner must then be placed back into service. In these instances, process time is lost and additional labor expense is realized.

The other of the two methods for bringing up the reaction zone temperature to within a desirable range entails the use of a dual-purpose burner which is capable of acting as a preheat burner and as a process burner; see, for example, the burner disclosed in U.S. Pat. No. 4,353,712. This type of burner provides conduits for selective and contemporaneous feeding of carbonaceous slurry, oxygen-containing gas, fuel gas and/or temperature moderators. When the burner is used for preheating the reactor, the burner feeds the oxygen-containing gas and the fuel gas in the proper proportions to achieve complete combustion. After the reactor temperature is within the desired range, the fuel gas can either be replaced completely by the carbonaceous slurry or co-fed with the slurry. When the co-feeding mode is used, generally the fuel gas feed is reduced so that there will only be partial oxidation occurring. Co-feeding is usually used when initially introducing the carbonaceous slurry to the reactor and when maintaining reactor temperature until process conditions can be equilibrated for the carbonaceous slurry/oxygen-containing gas feed mode of operation. While the use of a dual-purpose burner does not suffer from the loss in process time and the additional labor expenses of the preheat burner/process burner method, it is not without its own drawbacks. When using the dual-purpose burner, the maintenance of flame stability under both preheat conditions, i.e., ambient pressure-complete oxidation, and process conditions, i.e., high pressure, partial-oxidation, is difficult and can result in lowering of process reliability.

Some in the synthesis gas industry have proposed using the combination of a preheat burner and a process burner in which the latter is capable of providing a selective contemporaneous feed of carbonaceous slurry, oxygen-containing gas, fuel gas and/or temperature moderators. While this combination may still entail the loss of process time and the realization of labor costs associated with replacing the preheat burner with the process burner, the selective contemporaneous feed feature of the process burner is used to reduce the before-discussed thermal shock to the reactor refractory material. The reduction in thermal shock is achieved by bringing the reaction zone temperature from its cooled-down temperature, after preheat burner removal, back up to the desired temperature by initially using a feed of oxygen and fuel gas and then gradually replacing the fuel gas with the carbonaceous slurry. By gradually increasing the carbonaceous slurry fuel, there is less of the slurry liquid to heat and vaporize and thus a minimization of reactor temperature drop. Further, during the initial period of carbonaceous slurry feed, the continued feeding of the fuel gas results in the addition of heat to the reactor. The fuel gas is combusted under partial oxidation conditions so that there is little contamination by $CO_2$, etc., of the gas product.

For a process burner to be useful in the just-described procedure, it must be capable of providing to the reactor, in an efficient manner, the oxygen-containing gas and both the carbonaceous slurry and the fuel gas. Efficiency demands that the carbonaceous slurry be evenly dispersed in the oxygen-containing gas and be in a highly atomized state, e.g., having a maximum droplet size less than about 1000 microns. Both uniform dispersion and atomization help insure proper burn and the avoidance of hot spots in the reaction zone.

It is therefore an object of this invention to provide a process and a process burner which is capable of providing selective and contemporaneous feed to a reaction zone of three or more fluids in which one of the fluids is highly atomized and well dispersed in at least one of the remaining fluids.

THE INVENTION

This invention relates to an improved process for the manufacture of synthesis gas, fuel gas, or reducing gas by the partial oxidation of a carbonaceous slurry in a vessel, which vessel provides a reaction zone normally maintained at a pressure within the range of from about 15 to about 3500 psig (about 1 to about 239 atmospheres) and at a temperature within the range of from about 1700 to about 3500° F. (about 925 to about 1925° C.). The improvement comprises introducing a carbonaceous slurry and an oxygen-containing gas to a process burner, which process burner discharges into the reaction zone. Within the process burner, there is formed concentric and radially spaced streams. The formed streams comprise a central cylindrical oxygen-containing gas stream having a first velocity, an annular carbonaceous slurry stream having a second velocity, and a frusto-conical oxygen-containing gas stream having a third velocity. The central cylindrical oxygen-containing gas stream and the annular carbonaceous slurry stream have substantially coplanar discharge ends while the frusto-conical oxygen-containing gas stream, at its discharge end, converges into the central cylindrical oxygen-containing gas stream and the annular carbonaceous slurry stream. The velocities of the central cylindrical oxygen-containing gas stream and the frusto-conical oxygen-containing gas stream are greater than the velocity of the annular carbonaceous slurry stream. It is preferred that the two oxygen-containing gas streams have a velocity of from about 75 ft/sec (about 23 m/sec) to about sonic velocity and that the carbonaceous slurry stream have a velocity within the range of from about 1 (about 0.365 m/sec) to about 50 ft/sec (about 15 m/sec). The disparity between the stream velocities and the convergence of the frusto-conical oxygen-containing gas stream into the other two streams causes the carbonaceous slurry stream to disintegrate. This disintegration has two effects, i.e., the carbonaceous slurry is initially atomized and a uniform first dispersion of the initially atomized carbonaceous slurry and the oxygen-containing gas is formed. A second dispersion is formed by accelerating the first dispersion through an acceleration zone to further atomize the initially atomized carbonaceous slurry. The acceleration zone extends from a point downstream of the before mentioned streams to a point of discharge from the process burner. The acceleration zone has a cross-sectional area for flow less than the cross-sectional area for flow of the streams at their discharge ends. The second dispersion, which contains the highly atomized carbonaceous slurry, is then discharged from the acceleration zone into the reaction zone.

Accelerating the first dispersion through the acceleration zone is effected by providing a pressure, $P_1$, at a point adjacent the upstream of the acceleration zone which is greater than a pressure, $P_2$, which is measured at a point exteriorally of the process burner which is adjacent the discharge end of the acceleration zone. The difference between $P_1$ and $P_2$ is preferably maintained between about 10 to about 1500 psi (about 0.65 to about 102 atmospheres). In accordance with the laws of fluid dynamics and with the assumption of a constant stream throughput, the first dispersion will thus be accelerated as it passes through the acceleration zone. Also, the oxygen-containing gas portion of the first dispersion will accelerate quicker than the carbonaceous slurry particles formed by the initial atomization. This difference in acceleration causes further shearing of the carbonaceous slurry particles to yield further atomization of these particles. The acceleration zone is preferably cylindrical in shape, however, other configurations may be utilized. The dimensions of the acceleration zone are determinative of the residence time within the acceleration zone of the first dispersion and therefore are, at least in part, determinative of the degree of further atomization which occurs. The configuration and dimensions of the acceleration zone which will give the desired atomization are in turn dependent upon the $P_1$ and $P_2$ difference, the carbonaceous slurry viscosity, the temperature of the slurry of the carbonaceous slurry and the oxygen-containing gas, the presence of a temperature moderator, the relative amounts of the carbonaceous slurry and the oxygen-containing gas, and the like. With this number of variables, empirical determination of the acceleration zone configuration and dimensions is required.

The improved process of this invention is capable of providing to the reaction zone the carbonaceous slurry in a highly atomized form, i.e., the carbonaceous slurry has a volume median droplet size within the range of from about 100 to about 600 microns. Not only is the carbonaceous slurry highly atomized, it is also substantially uniformly dispersed in the oxygen-containing gas at the time that the slurry and gas are introduced into the reaction zone. By being able to provide such atomization and uniformity of dispersion, improved and highly uniform combustion is achieved in the reaction zone. Prior art process burners which do not provide this degree of atomization and dispersion can experience uneven burning, hot spots, and the production of unwanted by-products such as carbon, $CO_2$, etc. It is also an important feature of the process of this invention that the dispersions and atomizations occur interiorally of the process burner. Having the dispersions and atomizations substantially completed within the burner, allows for more exact control of the degree of atomization of the carbonaceous slurry before it is combusted in the reaction zone. The prior art burners which attempt to effect most, if not all, of the atomization within the reaction zone have less control over particle size as further atomization is forced to occur in an area, i.e., the reaction zone, which is by atomization standards unconfined. Also, the atomization process in the reaction zone has to compete time-wise with the combustion of the carbonaceous slurry and the oxygen-containing gas.

A preferred feature of the process of this invention is the additional formation of at least one fuel gas stream within the process burner. This fuel gas stream is discharged from the process burner into the reaction zone along a line which intersects the downstream extended longitudinal axis of the acceleration zone. One of the benefits realized by using this line of discharge is that the fuel gas flame is maintained at a distance from the burner face, i.e., the discharge end of the burner. If the fuel gas flame is adjacent the burner face then burner damage can occur. When the oxygen-containing gas is high in $O_2$ content, say 50%, then the introduction of fuel gas from the interior of a process burner is most undesirable as the flame propagation of most fuel gases in a high $O_2$ atmosphere is very rapid. Thus, there is always the danger that the flame could propagate up into the burner causing severe damage to the process burner.

The process burner of this invention comprises concentric and radially displaced central and middle conduits. The central conduit defines a cylindrical passageway having an open discharge end and having a fluid feed inlet upstream of its discharge end. The middle conduit and the first conduit together define an annular passageway concentric with the central passageway. The annular passageway has an open discharge end, a fluid feed inlet upstream of its discharge end and has its discharge end lying substantially in the same plane as the discharge end of the central passageway. By the phrase "lying substantially in the same plane", it is meant that the discharge ends of the cylindrical passageway and the annular passageway can lie in the same plane or can lie so that either of them is slightly more upstream than the other, say, by an amount of about 2" (5 cm). The process burner also has a frusto-conical conduit which defines a frusto-conical passageway which is coaxial with and displaced radially outward from the annular passageway. The frusto-conical passageway converges towards a point downstream of the discharge ends of the central and annular passageways. An acceleration passageway, which is in fluid communication and located downstream from the central, middle and frusto-conical passageways, is provided by an acceleration conduit. The acceleration passageway is also coaxial with the just mentioned passageways. The acceleration passageway has a cross-sectional area for flow less than the combined cross-sectional areas for flow of the central, middle and frusto-conical conduits at their discharge ends.

In a preferred form, the process burner of this invention additionally has at least one fuel gas conduit which defines a fuel gas passageway. The fuel gas passageway has an open discharge end substantially coplanar with and displaced radially outward of the discharge end of the acceleration conduit. The phrase "lying substantially in the same plane" has the same meaning as already defined for the relationship between the central conduit and the annular passageway and their discharge ends.

In a most preferred form, the frusto-conical passageway converges towards a point downstream of the discharge ends of the central annular passageway at an angle within the range of from about 15° to about 75°.

As mentioned previously, the manufacture of synthesis gas, fuel gas or reducing gas by the partial oxidation of a carbonaceous slurry generally takes place in a reaction zone having a pressure within the range of from about 15 to about 3500 psig (from about 2 to about 239 atmospheres) and a temperature within the range of from about 1700 to about 3500° F. (from about 925 to about 1925° C.). A typical partial oxidation gas generating vessel is described in U.S. Pat. No. 2,809,104. The produced gas stream contains, for the most part, hydrogen and carbon monoxide and may contain one or more of the following: $CO_2$, $H_2O$, $N_2$, Ar, $CH_4$, $H_2S$ and COS. The raw gas stream may also contain, depending upon the fuel available and the operating conditions used, entrained matter such as particulate carbon soot, flash or slag. Slag which is produced by the partial oxidation process and which is not entrained in the raw gas stream will be directed to the bottom of the vessel and continuously removed therefrom.

The term "carbonaceous slurries" as used herein refers to slurries of solid carbonaceous fuels which are pumpable and which generally have a solids content within the range of from about 40 to about 80% and which are passable through the hereinafter described conduits of the process burners of this invention. These slurries are generally comprised of a liquid carrier and the solid carbonaceous fuel. The liquid carrier may be either water, liquid hydrocarbonaceous materials, or mixtures thereof. Water is the preferred carrier. If the carrier is not water, then water, such as that provided by steam, is introduced to the reaction zone through the process burner to provide the needed water reactant for the reaction. The steam can be introduced with the oxygen-containing gas streams.

Liquid hydrocarbonaceous materials which are useful as carriers are exemplified by the following materials: liquified petroleum gas, petroleum distillates and residues, gasoline, naptha, kerosene, crude petroleum, asphalt, gas oil, residual oil, tar, sand oil, shale oil, coal-derived oil, coal tar, cycle gas oil from fluid catalytic cracking operations, fufural extract of coke or gas oil, methanol, ethanol, other alcohols, by-product oxygen-containing liquid hydrocarbons from oxo and oxyl synthesis and mixtures thereof, and aromatic hydrocarbons such as benzene, toluene, xylene, etc. Another liquid carrier is liquid carbon dioxide. To ensure that the carbon dioxide is in liquid form, it should be introduced into the process burner at a temperature within the range of from about −67° F. to about 100° F. depending upon the pressure. It is reported to be most advantageous to have the liquid slurry comprise from about 40 to about 70 weight percent solid carbonaceous fuel when liquid $CO_2$ is utilized.

The solid carbonaceous fuels are generally those which are selected from the group consisting of coal, coke from coal, char from coal, coal liquification residues, petroleum coke, particulate carbon soot in solids derived from oil shale, tar sands and pitch. The type of coal utilized is not generally critical as anthracite, bituminous, sub-bituminous and lignite coals are useful. Other solid carbonaceous fuels are for example: bits of garbage, dewatered sanitary sewage, and semi-solid organic materials such as asphalt, rubber and rubber-like materials including rubber automobile tires. As mentioned previously, the carbonaceous slurry used in the process burner of this invention is pumpable and is passable through the process burner conduits designated. To this end, the solid carbonaceous fuel component of the slurry should be finely ground so that substantially all of the material passes through and ASTM E 11-70C Sieve Designation Standard 140 mm (Alternative Number 14) and at least 80% passes through an ASTM E 11-70C Sieve Designation Standard 425 mm (Alternative Number 40). The sieve passage being measured with the solid carbonaceous fuel having a moisture content in the range of from about 0 to about 40 weight percent.

The oxygen-containing gas utilized in the process burner of this invention can be either air, oxygen-enriched air, i.e., air that contains greater than 20 mole percent oxygen, and substantially pure oxygen.

As mentioned previously, temperature moderators may be utilized with the subject process burner. These temperature moderators are usually used in admixture with the carbonaceous slurry stream and/or the oxygen-containing gas stream. Exemplary of suitable temperature moderators are water, steam, $CO_2$, $N_2$ and a recycled portion of the gas produced by the partial oxidation process described herein.

The fuel gas which is discharged exteriorally of the subject process burner includes such gases as methane, ethane, propane, butane, synthesis gas, hydrogen and natural gas.

Figure 2:
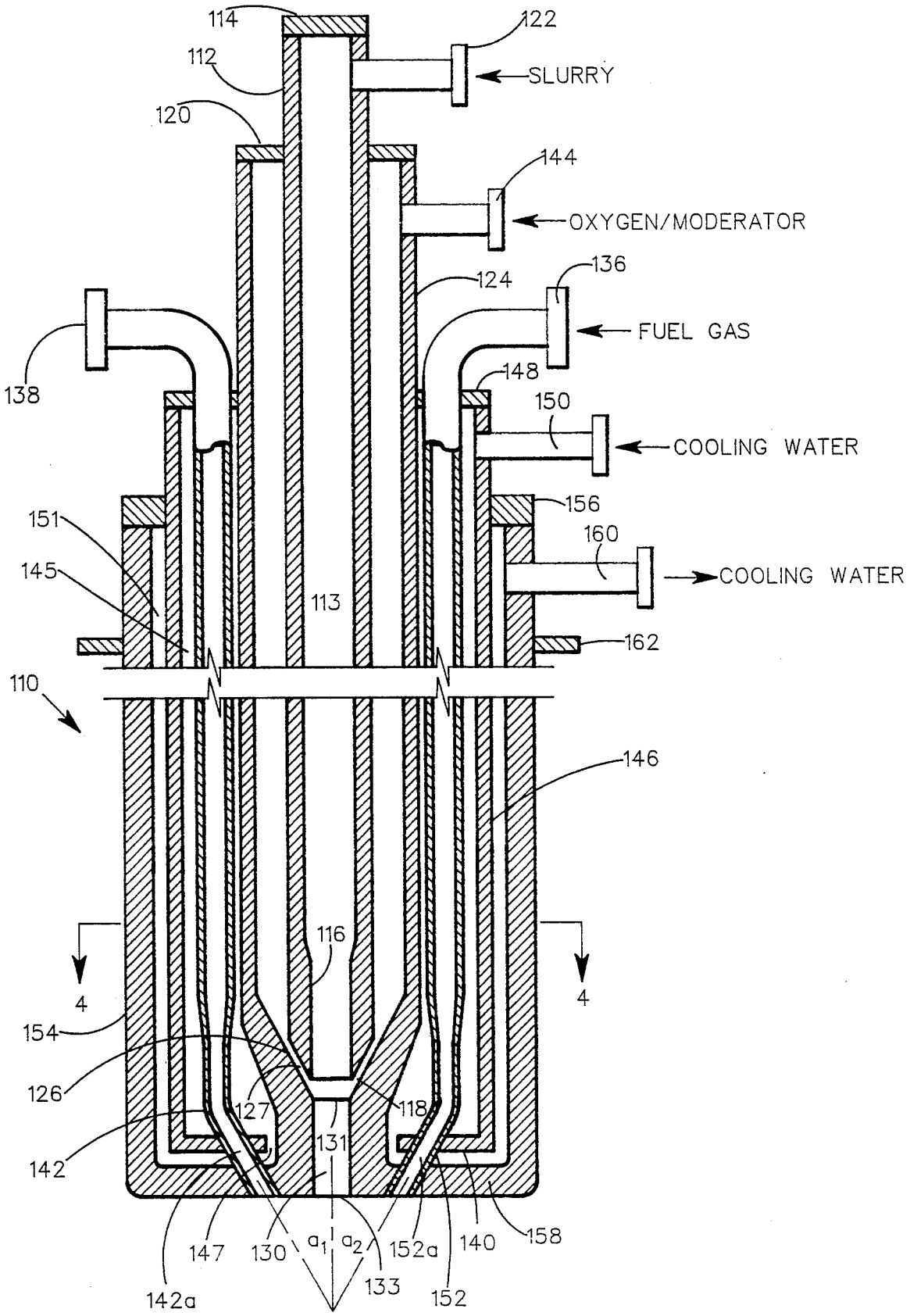
Figure 4:
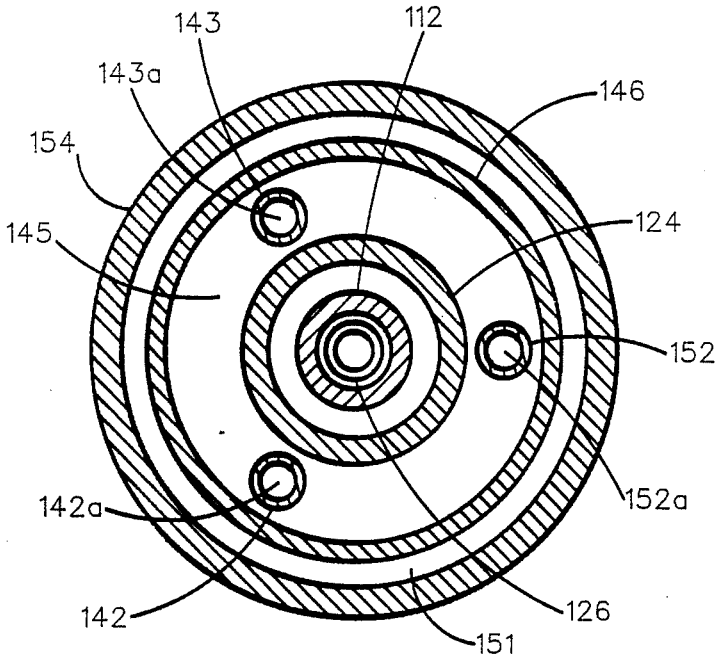
Figure 3:
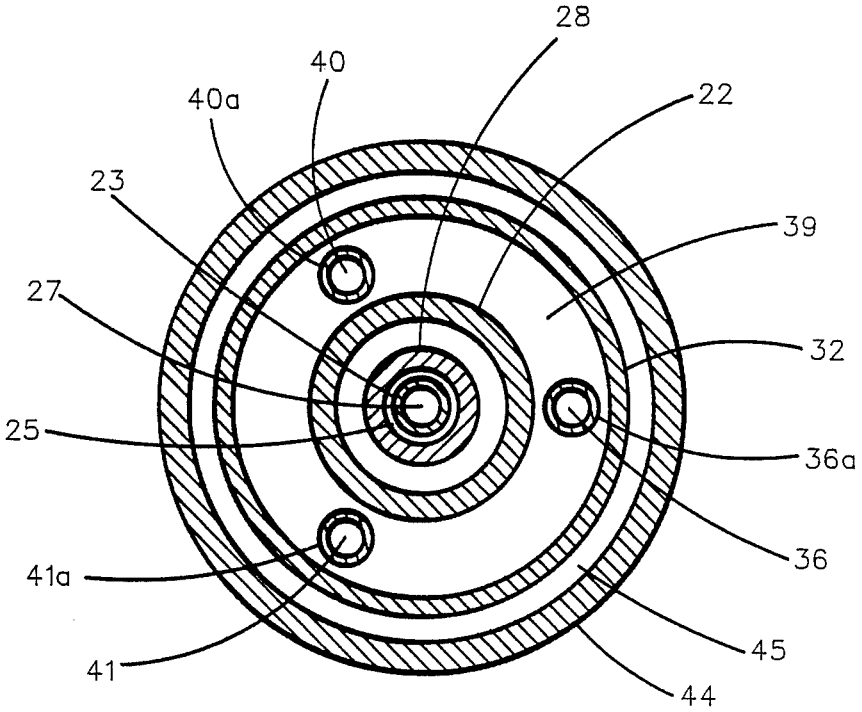

The high dispersion and atomization features of the process and the process burners of this invention and other features which contribute to satisfaction in use and economy in manufacture for the process burner will be more fully understood from the following description of a preferred embodiment of the invention when taken in connection with the accompanying drawings in which identical numerals refer to identical parts and in which:

FIG. 1 is a vertical cross-sectional view showing a process burner of this invention; and FIG. 2 is a sectional view taken through section lines 2—2 in FIG. 1.

Referring now to FIGS. 1 and 2, there can be seen a process burner of this invention, generally designated by the numeral 10. Process burner 10 is installed with the downstream end passing downwardly through a port made available in a partial oxidation synthesis gas reactor. Location of process burner 10, be it at the top or at the side of the reactor, is dependent upon reactor configuration. Process burner 10 may be installed either permanently or temporarily depending upon whether or not it is to be used with a permanently installed preheat burner or is to be utilized as a replacement for a preheat burner, all in the manner as herein described. Mounting of process burner 10 is accomplished by the use of annular flange 48.

Process burner 10 has a tube or conduit 22 which is closed off at its upper end by plate 21 and which has at its lower end a converging frusto-conical wall 26. At the apex of frusto-conical wall 26 is opening 35 which is in fluid communication with cylindrical acceleration zone 33. Acceleration zone 33, at its discharge end, terminates into discharge end 30. For the embodiment shown in the drawings, acceleration zone 33 is a hollow cylindrically shaped zone.

Passing through and in gas-tight relationship with an aperture in plate 21 is carbonaceous slurry feed line 14. Carbonaceous slurry feed line 14, at its downstream end is connected to a port in an annular plate 17 which closes off the upper end of a distributor 16. Distributor 16 has a converging frusto-conical lower wall 19. At the apex of frusto-conical wall 19 is a downstream extending tube or conduit 28 which defines, along with tube or conduit 23, a middle annular passageway 25. The inside diameter of tube 28 is substantially less than the inside diameter, at its greatest extent, of distributor 16. It has been found that by utilizing distributor 16 the flow of the carbonaceous slurry stream from the discharge end of conduit 25 will be substantially uniform throughout its annular extent. Determination of the inside diameter of the distributor 16 and the inside diameter of tube 2 and the outside diameter of tube 23 is made so that the pressure drop that the carbonaceous slurry stream experiences as it passes through annular passageway 25, is much greater than the difference between the highest and lowest pressures present in the carbonaceous slurry stream measured across any annular horizontal cross-sectional plane inside of distributor 16. If this pressure relationship is not maintained, it has been found that uneven annular flow will occur from the discharge end of annular passageway 25 resulting in the loss of dispersion efficiency when the carbonaceous slurry contacts the oxygen-containing gas stream as hereinafter described.

The difference between the inside and outside diameters of annular passageway 25 is at least partially dependent upon the fineness of the carbonaceous material found in the slurry. The diameter difference should be sufficiently large to prevent plugging by the particular size of the carbonaceous material found in the slurry. The difference between the inside and outside diameters of annular passageway 25 will, in many applications, be within the range of from about 0.1 (0.254 cm) to about 1.0 inches (2.54 cm).

Coaxial with the longitudinal axis of downwardly depending tube 28 is tube 23 which has, throughout its extent, a substantially uniform diameter. Tube 23 provides a central passageway 27 for the passage of an oxygen-containing gas and is open at both its upstream and discharge ends with the discharge end being substantially coplanar with the discharge end of tube 28.

The oxygen-containing gas is fed to process burner 10 through feed line 24. A portion of the oxygen-containing gas will pass into the open end of central passageway 27. The remainder of the oxygen-containing gas flows through gas passageway 31 which is annular and defined by the inside wall of tube 22 and the outside wall of tube 28. The gas passing through gas passageway 31 will be accelerated as it is forced through frusto-conical passageway 29 defined by frusto-conical surface 26 and frusto-conical surface 20. This acceleration is due to the frusto-conical conduit having a cross-sectional area less than that of gas passageway 31. The distance between frusto-conical surfaces 20 and 26 is such so as to provide the oxygen-containing gas velocity required to effectively disperse and initially atomize the carbonaceous slurry stream flowing out of annular passageway 25. For example, it has been found that when the oxygen-containing gas passes through central passageway 27 at a calculated velocity of about 200 ft/sec (about 61 m/sec) and the carbonaceous slurry passes through annular passageway 25 at a velocity of about 8 ft/sec (about 2.4 m/sec) and has an inside, outside diameter difference of about 0.3 inches (about 0.76 cm), the oxygen-containing gas should pass through frusto-conical passageway 29 at a calculated velocity of about 200 ft/sec (about 61 m/sec). Generally speaking, for the flow velocities just and hereinafter discussed, the distance between the two frusto-conical surfaces is within the range of from about 0.05 inches (about 0.127 cm) to about 0.95 inches (about 2.41 cm). With these flows and relative velocities, it has also been found that, when acceleration zone 33 is a cylinder, it will have a height and diameter of about 7 inches (about 17.8 cm) and about 1.4 inches (about 3.5 cm), respectively.

Frusto-conical passageway 29 converges towards a downstream point which is on the extended longitudinal axes of tubes 23 and 28 along an angle within the range of from about 15° to about 75°.

Concentrically located with respect to tube 22 is water jacket 32. Water jacket 32 is closed off at its uppermost end by annular plate 58. At the lowermost end of water jacket 32 is annular plate 42 which extends inwardly but which provides an annular water passageway 43. Located within the annular space 39 found between the outside wall of tube 22 and the inside wall of water jacket 32 are three fuel gas passageways 36, 40 and 41 which are provided by tubes 36*a* and 40*a* and 41*a* respectively. Tubes 36*a*, 40*a* and 41*a* pass through apertures in flange 42 as seen in FIG. 1. Fuel gas is fed through tubes 40*a* and 36*a* by way of feed lines 52 and 50 respectively. The feed line for tube 41*a* is not shown but is the same type utilized for the other tubes.

As can also be seen in FIG. 1, fuel gas passageways 40 and 36 (and likewise for fuel gas passageway 41), are angled towards the downstream extended longitudinal axis of acceleration zone 33. The passageways are also equiangularly and aquidistantly radially spaced about this same axis. This angling and spacing is beneficial as it uniformly directs the fuel gas into the oxygen-containing gas or the carbonaceous slurry/oxygen-containing gas dispersion subsequent to its discharge through acceleration zone discharge end 30. The choice of angularity for the fuel gas conduits should be such that the fuel gas is introduced sufficiently far away from the burner face but not so far as to impede quick mixing or dispersion of the fuel gas into the oxygen-containing gas or the carbonaceous slurry/oxygen-containing gas dispersion discharged from process burner 10. Generally speaking, the angles $a_1$ and $a_2$ as seen in FIG. 1 should be within the range of from about 30° to about 70°.

Concentrically mounted and radially displaced outwardly from the outside wall of water jacket 32 is burner shell 44. The radial outward displacement of burner shell 44 provides for an annular water passageway 45. At the upper end of burner shell 44 is water discharge line 56. As is seen in FIG. 1, water which enters through water feed line 54 flows to and through water passageway 43 and thence through annular water passageway 45 and out water discharge line 56. This flow of water is utilized to keep process burner 10 at a desired and substantially constant temperature.

Burner shell 44 is closed off at its upper end in a water-tight manner by annular flange 60. Burner shell 44 is terminated at its lowermost end by burner face 46.

As before mentioned, the process burner of this invention may be utilized alone or in combination with a preheat burner. When a preheat burner is utilized, the preheat burner heats the reaction zone to a temperature within the range of from about 1500 to about 2500° F. (about 925 to about 1925° C.). Since the reaction zone may cool down between shutting off the preheat burner and the lighting of process burner 10, it may be necessary to use process burner 10 to bring the reaction zone to a temperature within the desired range. This is accomplished by feeding an oxygen-containing gas to process burner 10 through line 24 and fuel gas through fuel gas lines 50–52 and the fuel gas line which is not shown. As the reaction zone approaches the desirable temperature. The gradual feeding of a carbonaceous slurry to feed line 14 is started. As the process continues, the feed of fuel gas is decreased and the feed of the carbonaceous slurry is increased. By utilizing this gradual conversion from fuel gas feed to carbonaceous slurry feed, thermal shock to the reaction zone is avoided. It is important also to carefully regulate the feed of carbonaceous slurry and fuel gas during this period so that at least a substantial portion of the carbon in the carbonaceous slurry and in the fuel gas is converted to the desirable CO and $H_2$ components of the product gas and so that the proper reaction zone temperature is maintained. Should a reaction zone upset occur and the carbonaceous slurry feed have to be reduced, then the fuel gas feed will be brought back on line in an amount sufficient to keep the reaction zone within the desired temperature range.

The dwell time in the reactor for the feed streams subsequent to their leaving process burner 10 will be about 1 to about 10 seconds.

The oxygen-containing gas will be fed to process burner 10 at a temperature dependent upon its $O_2$ content. For air, the temperature will be from about ambient to about 1200° F. (about 650° C.), while for pure $O_2$, the temperature will be in the range of from about ambient to about 800° F. (427° C.). The oxygen-containing gas will be fed under a pressure of from about 30 to about 3500 psig (about 3 to about 238 atmospheres). The carbonaceous slurry will be fed at a temperature of from about ambient to about the saturation temperature of the liquid carrier and at a pressure of from about 30 to about 3500 psig (about 3 to about 238 atmospheres). The fuel gas is preferably methane and is fed at a temperature of from about ambient to about 1200° F. (about 650° C.) and under a pressure of from about 30 to about 3500 psig (about 3 to about 238 atmospheres). Quantitatively, the carbonaceous slurry, fuel gas and oxygen-containing gas will be fed in amounts to provide a weight ratio of free oxygen to carbon which is within the range of from about 0.9 to about 2.27.

The carbonaceous slurry is fed via feed line 14 to the interior of distributor 16 at a preferred flow rate of from about 0.1 to about 5 ft/sec (about 0.03 m/sec to about 1.5 m/sec) Since the diameter of annular passageway 25, provides a cross-sectional area for flow smaller than that provided by distributor 16, the velocity of the carbonaceous slurry stream in annular passageway 25 will increase to be within the range of from about 1 to about 50 ft/sec (about 0.3 to about 15.24 m/sec).

The oxygen-containing gas is fed through feed line 24 and is made into two streams, one stream passing through central passageway 27 and the other passing through frusto-conical passageway 29. The oxygen-containing gas streams can have the same or different velocities, for example, the velocity through gas passageway 27 can be 200 ft/sec (61 m/sec) and the velocity through frusto-conical passageway 29 can be 300 ft/sec 91.5 m/sec). The carbonaceous slurry stream exiting annular passageway 25 and the oxygen-containing gas stream exiting central passageway 27 are intersected by the frusto-conical stream of oxygen-containing gas exiting frusto-conical passageway 29 at a point just downstream of the discharge ends of passageways 25 and 27. This intersecting results in a shearing of the carbonaceous slurry stream with an initial atomization of the carbonaceous slurry and the formation of a substantially uniform first dispersion of the initially atomized carbonaceous slurry and the oxygen-containing gas.

The resultant first dispersion is then passed through acceleration zone 33 which is dimensioned and configured to accelerate the first dispersion to further atomize the carbonaceous slurry particles in the first dispersion to a volume median droplet size within the range of from about 100 to about 600 microns and to form a second dispersion which exits the discharge end 30 of acceleration zone 33.

We claim:

1. A process burner which consists essentially of:

(a) concentric and radially spaced central and middle conduits, wherein (i) the central conduit defines a cylindrical passageway having an open discharge end and having a fluid feed inlet upstream of its discharge end, and (ii) the middle conduit and central conduit define an annular passageway concentric with the central passageway, the annular passageway has an open discharge end, a fluid feed inlet upstream of its discharge end and has its discharge end lying substantially in the same plane as the discharge end of the central passageway;

(b) a frusto-conical conduit which defines a frusto-conical passageway which is coaxial with and displaced radially outward from the annular passageway, the frusto-conical passageway converges towards a point downstream of the discharge ends of the central and annular passageways; and (c) an acceleration conduit defining a coaxial acceleration passageway which is coaxial and in fluid communication with, located downstream from the central, middle and frusto-conical passageways, and connected at its upper end to the apex of the frusto-conical conduit, the acceleration passageway has a cross-sectional area for flow less than the combined cross-sectional areas for flow of the central, middle and frusto-conical conduits at their discharge ends.

2. The process burner of claim 1 wherein the frusto-conical passageway converges towards a point downstream of the discharge ends of the central and annular passageways at an angle within the range of from about 15° to about 75°.

3. A process burner comprising:

(a) concentric and radially spaced central and middle conduits, wherein (i) the central conduit defines a cylindrical passageway having an open discharge end and having a fluid feed inlet upstream of its discharge end, and (ii) the middle conduit and central conduit define an annular passageway concentric with the central passageway, the annular passageway has an open discharge end, a fluid feed inlet upstream of its discharge end and has its discharge end lying substantially in the same plane as the discharge end of the central passageway;

(b) a frusto-conical conduit which defines a frusto-conical passageway which is coaxial with and displaced radially outward from the annular passageway, the frusto-conical passageway converges towards a point downstream of the discharge ends of the central and annular passageways;

(c) an acceleration conduit defining a coaxial acceleration passageway which is coaxial and in fluid communication with, located downstream from the central, middle and frusto-conical passageways, and connected at its upper end to the apex of the frusto-conical conduit, the acceleration passageway has a cross-sectional area for flow less than the combined cross-sectional areas for flow of the central, middle and frusto-conical conduits at their discharge ends; and (d) at least one fuel gas conduit which defines a fuel gas passageway which has an open discharge end lying substantially in the same plane with and displaced radially outward of the discharge end of the acceleration conduit, the fuel gas passageway being directed towards the downstream extended longitudinal axis of the acceleration conduit.

* * * * *